United States Patent [19]

Habib et al.

[11] 4,094,681

[45] June 13, 1978

[54] IMAGE AMPLIFICATION OF NEGATIVE-WORKING DIAZO MATERIALS

[75] Inventors: David P. Habib, East Greenwich; Gilbert Zweig, Barrington, both of R.I.

[73] Assignee: Trans World Technology Laboratories, Inc., Fiskeville, R.I.

[21] Appl. No.: 625,042

[22] Filed: Oct. 23, 1975

[51] Int. Cl.[2] ..... G03C 5/34; G03C 5/18; G03C 5/20

[52] U.S. Cl. ..... 96/49; 96/27 R; 96/47; 96/68; 96/75; 96/91 R; 96/91 D

[58] Field of Search ..... 96/49, 75, 91 R, 91 D, 96/68, 47, 27 R

[56] References Cited

U.S. PATENT DOCUMENTS

| | | | |
|---|---|---|---|
| 1,444,469 | 2/1923 | Kogel | 96/91 D |
| 1,926,322 | 9/1933 | Van der Grinten et al. | 96/91 D |
| 2,106,868 | 2/1938 | De Boer et al. | 96/91 D |
| 2,114,468 | 4/1938 | Van der Grinten | 96/47 |
| 3,313,626 | 4/1967 | Whitney | 96/68 |
| 3,466,172 | 9/1969 | Skarvinko | 96/49 |
| 3,479,183 | 11/1969 | Habib et al. | 96/49 |
| 3,511,658 | 5/1970 | Manko et al. | 96/68 |
| 3,515,547 | 6/1970 | Allentoff et al. | 96/49 |
| 3,663,228 | 5/1972 | Wyckoff | 96/68 |
| 3,713,825 | 1/1973 | Girard | 96/49 |

FOREIGN PATENT DOCUMENTS

| | | | |
|---|---|---|---|
| 1,174,339 | 12/1969 | United Kingdom | 96/49 |
| 1,176,548 | 1/1970 | United Kingdom | 96/49 |

OTHER PUBLICATIONS

Kosar; J., "Light-Sensitive Systems," J. Wiley & Sons, 1965, pp. 267–272.

Anon, *Research Disclosure,* 10/1972, pp. 58–62.

*Primary Examiner*—Charles L. Bowers, Jr.

*Attorney, Agent, or Firm*—Birch, Stewart, Kolasch and Birch

[57] ABSTRACT

A method for the amplification or intensification of dye images formed in a negative-working diazo system which comprises the steps of: (1) initially image-wise exposing a negative-working diazo layer to actinic radiation sufficient to convert a portion of the diazo compound contained therein to an active coupling constituent in the light-struck areas to form a first latent image, (2) developing the exposed diazo layer to effect coupling so as to form colored incipient images in the light-struck areas, (3) exposing the entire diazo layer from the same side as the initial image-wise exposure to actinic radiation of a greater amount than that used in the initial exposure, said amount of actinic radiation being sufficient to substantially photolyze the non-image areas while simultaneously creating second latent images beneath the already-developed areas, and (4) developing the exposed diazo layer again to effect coupling in said second latent image areas to form color therein and to amplify the initial colored incipient images. Further amplification may be obtained by exposing the diazo layer from the side opposite that of the initial exposure and again developing to effect coupling of any remaining diazo under the original dye image areas.

17 Claims, 9 Drawing Figures

IMAGE AMPLIFICATION OF NEGATIVE-WORKING DIAZO MATERIALS

Figure 1:
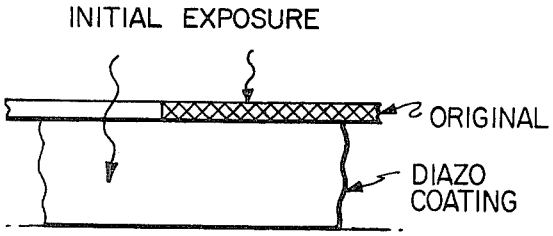

This invention relates to negative-working diazo systems. More particularly, it relates to the amplification (intensification) of the dye images formed in a negative-working diazo system.

Basically, diazotype processes rely upon the light-sensitivity of diazo salts and the fact that such salts undergo two different types of reactions, i.e., replacement or decomposition in which the nitrogen is lost as nitrogen gas and coupling wherein the nitrogen of the diazo group is retained and the salts react with certain coupling components to form azo dyes. In positive-working processes, the action of light causes photochemical decomposition of the diazo compound. An image is developed in the unexposed areas by the combination of the diazo compound with a coupling component, which is generally an aromatic amine, phenol, phenol ether or aliphatic compound containing active methylene groups, to form colored oxyazo or aminoazo compounds, i.e., azo dyes.

Positive-working diazo material is imaged by first exposing it through a master transparency or original. The light in the exposure step must supply sufficient energy to destroy or decompose the diazo compound in the areas corresponding to the clear background of the original. High-pressure mercury vapor lamps are generally used in performing this step. The part of the diazo coating which is unprotected from the ultraviolet radiation by the image on the original becomes a colorless substance, incapable of coupling to form a dye. However, the unaffected diazo compound which remains in those areas where the light has not struck is capable of forming an azo dye with a coupling component when the medium is made alkaline. Thus, wherever an opaque line appeared on the original, a dye line appears on the copy. Positive-working, diazotype photoreproduction material is generally made alkaline either by impregnating the material with ammonia vapors or by passing it through an alkaline developing solution.

In the lesser known negative-working or reversal process, such as that of the present invention, a dye is formed in the exposed areas but not in the areas protected from light. Thus a negative, or reversed, copy of the original results. Such negative-working diazo-imaging systems have been studied in the prior art, as exemplified by U.S. Pat. No. 2,854,338 of Herrick et al, 3,479,183 of Habib et al and 3,713,825 of Girard, but they have had only limited commercial success, primarily because of their inability to provide commercially acceptable image contrast (J. Kosar, "Light Sensitive Systems", John Wiley & Sons, Inc., New York, pages 267–269 (1965)). However, because of the many potential applications for negative-working diazo systems, improved image contrast with a correspondingly improved product is a goal which has been sought in this art for a long time.

Accordingly, one of the objects of the present invention is to provide a negative-working diazo system which provides an enhanced image contrast as compared with the systems of the prior art.

Another object of the invention is to provide a procedure for the image amplification or intensification of negative-working diazo systems which may be carried out readily and effectively.

Figure 5:
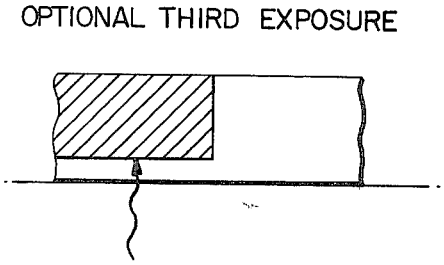
Figure 6:
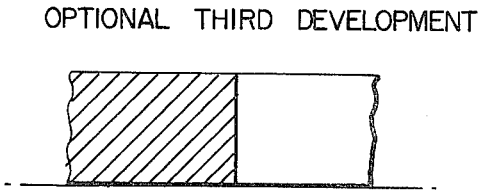
Figure 7A:
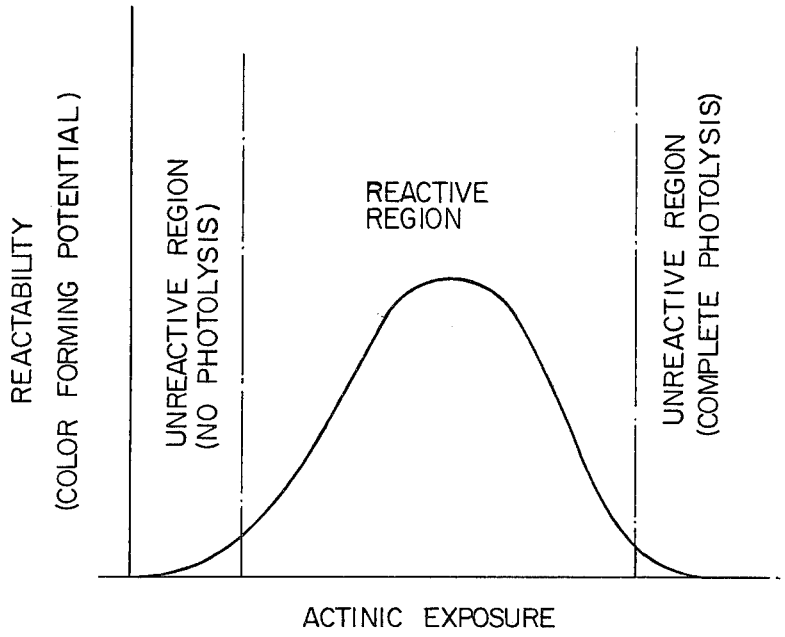
Figure 7B:
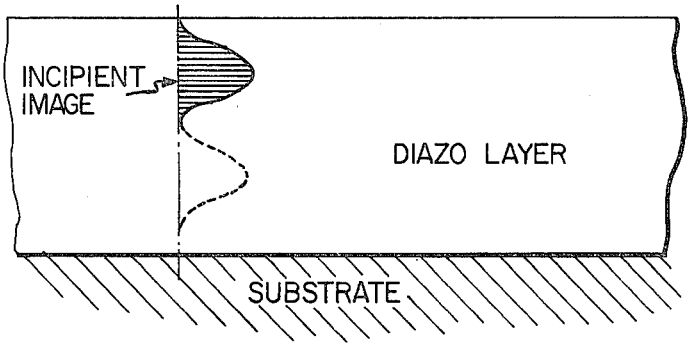
Figure 8:
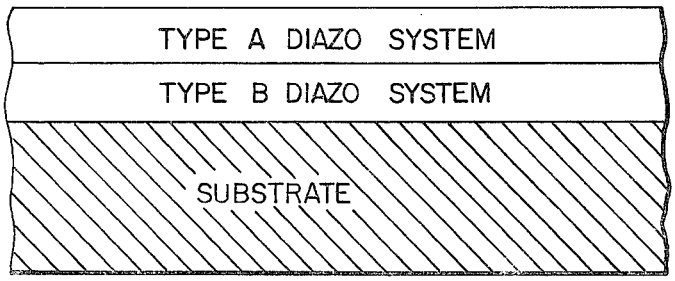

These and other objects and advantages of the present invention will become apparent to those skilled in the art from a consideration of the following specification and claims, taken in conjunction with the accompanying drawings wherein:

FIGS. 1–6 illustrate schematically the progressive steps involved in the image amplification procedure of the present invention, FIG. 7A shows the reactability (color forming potential) with actinic exposure of the diazo compounds used in the negative-working systems of the invention, FIG. 7B shows schematically a distribution profile of the incipient dye image in the diazo layer, indicating the correlation with the photolysis curve of FIG. 7A, and FIG. 8 illustrates a system having multiple but separate diazo-containing layers.

In accordance with the present invention, increased image density and contrast are obtained in a diazo negative-working system by initially image-wise exposing a negative-working diazo system to actinic radiation to within a controlled extent, developing the exposed diazo sheet to form incipient dye images in the light-struck areas, clearing the sheet or film by re-exposure, and then redeveloping the cleared film under the same conditions as the original development to increase image density.

Specifically, the steps involved in this procedure are as follows:

(1) A controlled initial imagewise exposure to actinic radiation which causes the partial photolysis of a predetermined fraction of the diazo compound in light-struck areas. The product of this photolytic decomposition is capable of coupling with its complementary form to produce an azo dye (see FIG. 1).

Figure 2:
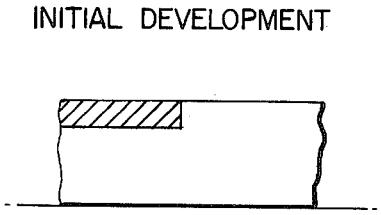

(2) A development step consisting of a coupling reaction induced by an alkaline agent and/or heat. This step results in the formation of incipient dye images in the light-struck areas where coupling has taken place, as illustrated in FIG. 2.

Figure 3:
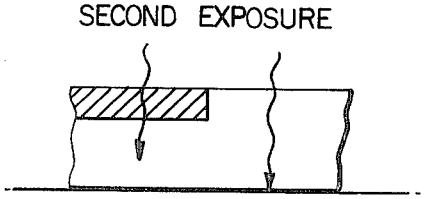

(3) A second, but overall exposure, of the incipient image-bearing diazo-coated sheet through the same side of the diazo coating as the initial exposure was made. The magnitude of this exposure should be greater than the initial exposure. In general, the amount of increase should be about 2 to 100 times that of the initial exposure. This step is schematically shown in FIG. 3. In those areas where no incipient image is formed, this second exposure results in the total decomposition by photolysis of the diazo compound and no further dye-forming potential exists in these areas. In the areas where incipient dye images are present, these dye images attenuate the second exposure to the extent that only partial photolysis of the diazo compound present thereunder takes place. As in the initial exposure, the products of this photolysis are again capable of coupling to form additional dye and, hence, to intensify or amplify the incipient dye image.

Figure 4:
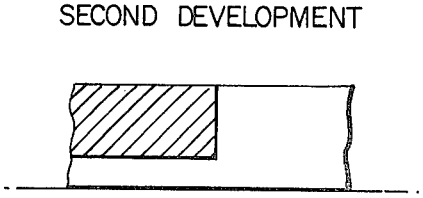

(4) A second development, illustrated in FIG. 4, similar to the first development step to cause additional dye formation and consequent amplification of the incipient image is then carried out.

At this point, the possibility exists that unphotolyzed diazo compound remains under the dye image areas and, hence, optionally, to obtain even greater image amplification by additional photolysis and subsequent development, the steps shown in FIGS. 5 and 6 can be carried out. Hence, a third overall exposure can be given the image-bearing sheet, however, this exposure is made through the side opposite that through which the first two exposures were made. The magnitude of this exposure should favorably be of the order of that of the initial exposure. A third development will result in additional dye image density.

Hence, it can be seen that the negative-working diazo system used in this invention comprises a system in which one of the image-forming constituents is in a precursor or unreactive form until photolyzed. In order to produce the higher density image, the light-sensitive coating in this system is subjected to actinic radiation to cause partial photolysis of the diazo constituent. Coupling of the dye components is then induced by suitable means. This is followed by an additional photolysis at longer exposures to create additional coupling species which are then developed to form additional dye density.

Accordingly, the basic principle underlying the present invention is that the diazo compound, on continued exposure to actinic radiation, be capable of proceeding through a photolytic transition starting with an unreactable (i.e., non-dye former) state to a reactable state (in which it is capable of coupling to form a dye) and, finally, to an unreactable state due to complete photolysis (see FIG. 7A). FIG. 7B illustrates this principle in the present invention. The shaded area under the curve illustrates an incipient dye image (color front) formed after the first development step. Amplification of this dye image is obtained by the formation of a second color front directly underneath the first image by the second exposure and development steps, as shown by the dotted lines in FIG. 7B. It can be readily seen therefrom that the dye distribution profile in the diazo layer shown in FIG. 7B substantially simulates the photolysis curve of FIG. 7A.

The imaging system of the invention therefore comprises the following components: (1) a light-photolyzable diazo compound which serves as a precursor for either a color former (Type A), or an "active" diazo (Type B), (2) an acidic stabilizer, (3) a color former (coupler), for those systems where the precursor produces an "active" diazo, i.e., Type B, and (4) a suitable support or substrate. In a case where the binder or support itself is acidic, e.g., an acidic polymer, the addition of an acidic stabilizer as such may not be necessary.

Illustrative of these two types of systems are the following: Precursor photolyzable to a Color Former (Type A):

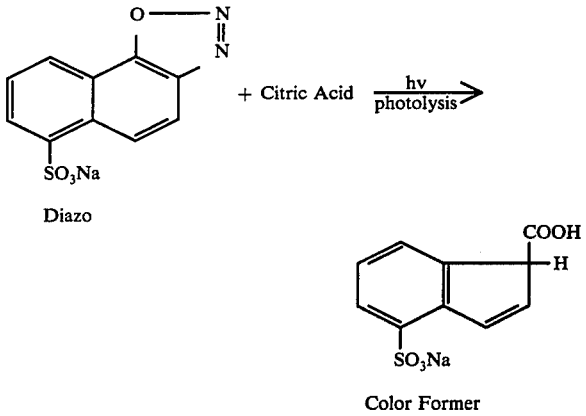

In practice, only partial photolysis occurs, so that both species required for coupling remain in the system. Complete photolysis of the diazo oxide results in the total transition thereof, thereby destroying any further color-forming capability. Precursor photolyzable to an "Active" Diazo (Type B):

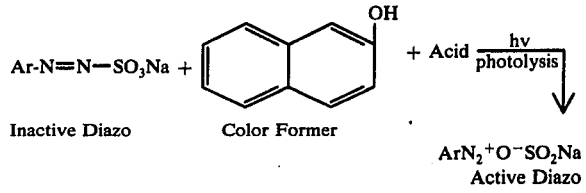

Photolysis to the "active" diazo form thus provides the second component required for coupling, the first component already being present as the color former. Complete photolysis of the "active" diazo results in loss of further dye-forming capability.

Systems combining both Type A and Type B components may be employed in the present invention. Such a system comprises precursors for both the "active" diazo and the color former as well as an acidic stabilizer. For example:

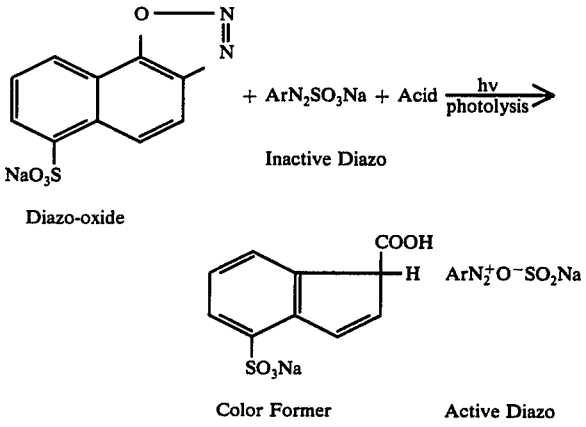

In a mixed Type A and Type B system of this kind, it is important to exclude any color former in the initial formulation, as it would couple with the diazo-oxide during the first development stage, thereby giving an excessively high Dmin.

In order for the process of image amplification in accordance with this invention to be particularly effective, there must be a sufficient concentration of diazo compound to accommodate the formation of the incipient dye image as well as the amplified dye image. Typically, the Absorbance of the unexposed diazo layer in the spectral region of maximum absorption of the diazo, as measured by an ultraviolet/visible spectrophotometer should be in excess of 1.0. Suitable diazo compounds meeting the necessary requirements include diazos derived from benzene, naphthalene and heterocyclic conjugated structures.

Typical diazo structures in the Type A category include the following aromatic diazo oxides:

2,1-naphthalene-diazo-oxide-5-sodium sulfonate

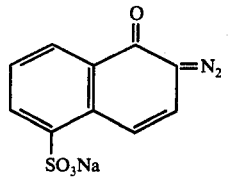

2,1-naphthalene-diazo-oxide-4-sodium sulfonate

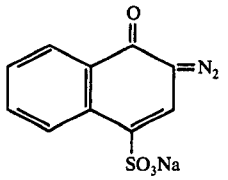

1,2-naphthalene-diazo-oxide-6-nitro-4-sodium sulfonate

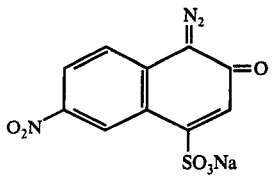

1,2-benzene-diazo-oxide-5-sodium sulfonate

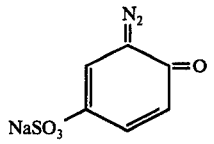

2,1-naphthalene-diazo-oxide-5-sulfonic acid-p-tolyl ester

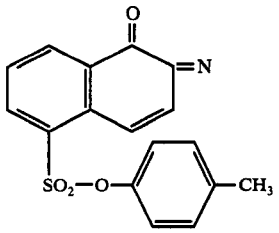

4,6-dichloro-1,2-benzoquinone diazide

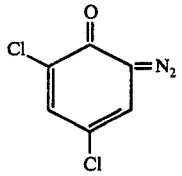

4-chloro-1,2-benzoquinone diazide

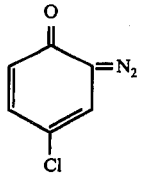

Typical diazosulfonate structures in the Type B category include:

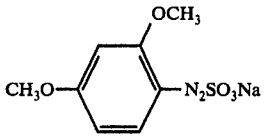

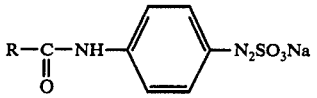

wherein R is phenyl or alkyl

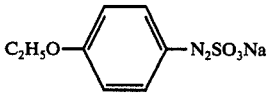

In addition to the diazosulfonates in the Type B category, it is possible to use other "inactive" diazo compounds which are light-photolyzable to the "active" diazo form, providing they form a suitable negative-working diazo system and conform to the basic requirements for amplification discussed above. Compounds in this category include diazosulfones and diazocyanides. Couplers for the Type B diazo compounds include, for example, hydroxyl-containing organic compounds such as resorcinol, diresorcinol sulfide, phloroglucinol, 2,3-dihydroxynaphthalene, 2,4,6-trihydroxybenzoic acid, 2-methylresorcinol, 2,4-dihydroxybenzene ethanolamide, 2-hydroxynaphthalene-3-carboxylic acid ethanolamide, α-resorcyclic acid and 1,8-dihydroxynaphthalene-4-sulfonic acid sodium salt.

In addition to using Type A and Type B diazo compounds in single layered systems, it is possible to use them in multiple, separate layers. FIG. 8 illustrates such a system. Thus, for example, a diazo-oxide in a Type A layer serves to form the incipient image, and the diazosulfonate in a Type B layer serves to form the amplifying image. Of course, these layers could be reversed. By this means, it is possible to more precisely adjust the actinic opacity of both the incipient image and amplifying image to achieve an enhanced actinic opacity of the total image.

Another alternative procedure suitable in the present invention would be to coat both sides of a film or sheet with the diazo system described herein, whereby the incipient image is formed on one side and the amplified image is formed on the other side.

Acidic stabilizers known in the art may be used in the negative-working diazo system of the invention. Suitable acidic stabilizers include citric acid, tartaric acid, malic acid, sulfosalicylic acid, maleic acid, fumaric acid, salicylic acid, lactic acid, mellitic acid, ethoxyacetic acid, o-chlorobenzoic acid, etc.

Suitable film or sheet supports, i.e., the substrate for the diazo layer, are those conventionally employed in the art, such as Mylar (polyethylene terephthalate), polystyrene, cellulose acetate, polycarbonates, paper, cloth, various metal foils or sheets, etc.

Exposure of the diazo layer is carried out with light sources conventionally employed for diazo materials, for example, mercury vapor lamps and mercury fluorescent lamps. The clearing exposures are usually about ten times that of the initial exposure for the particular diazo employed. Development after each of the exposures is effected with the use of an alkaline agent, such as ammonia or a volatilizable amine, or by heating per se. If a volatile alkaline agent is employed, it is preferred that the agent in the diazo layer be driven off or in some manner neutralized to minimize coupling during the second exposure. In the case of ammonia, this may be accomplished by mild heating. A typical device for developing the diazo system of the invention is the ammonia-developing section of an integrated diazo print maker or in a separate ammonia-developing machine, such as the Arkwright Model 404. In general, high developing temperatures and a moderate ammonia feed are desired. For liquid-feed machines, a 26° Baume aquaammonia solution is favorably employed. A temperature range of about 200° to 240° F, is recommended. For thermal-developing machines, temperatures of about 160° to 270° F. are favorably employed.

By following the steps of image-wise exposure, development, overall exposure and second development, a surprisingly excellent image contrast is obtained using the negative-working diazo systems of the invention.

The following examples are given merely as illustrative of the present invention and are not to be considered as limiting.

The following lacquer solution is used in preparing the coating formulation in all of the following examples:

| | | Grams |
|---|---|---|
| Acetone | | 22.3 |
| Toluene | | 37.0 |
| Ethanol (95%) | | 8.0 |
| 0.5-second Cellulose Acetate Propionate (Eastman Kodak) | | 15.9 |
| Dissolve, then add | | |
| MA28/18 Resin (Bakelite) | premixed | 0.8 |
| Ethanol (95%) | premixed | 15.9 |

EXAMPLE 1

A light-sensitive formulation comprising the following components is prepared for coating an ICI 505 polyester film:

| | Grams |
|---|---|
| Methanol | 55.0 |
| Acetone | 30.0 |
| Methyl Cellosolve Acetate | 5.0 |
| Formic Acid | 10.0 |
| Citric Acid | 1.0 |
| 2,1-naphthalene-diazo-oxide-5-sodium sulfonate | 3.8 |

The solution is warmed to help in dissolving the diazo-oxide. It is then mixed with the lacquer solution in a 1:1 ratio and coated on the polyester base, with a No. 60 Meyer Bar. The sheet is then dried in an oven at 100° C. for one minute.

After drying, the sheet is exposed imagewise for 9 seconds at Low Intensity on a DGS 1400 exposure device and developed in an Arkwright 404 ammonia developer. The film is allowed to de-ammoniate for 3–5 minutes at room temperature, after which it is re-exposed overall for 60 seconds from the same side as the original exposure and developed for a second time to obtain the amplified image.

A MacBeth TD518 densitometer with a No. 93 (green) filter is used to measure the image density. The density before amplification is 0.81, and 1.25 after amplification.

EXAMPLE 2

A light-sensitive formulation comprising the following components is prepared for coating on ICI 505 polyester film:

| | Grams |
|---|---|
| Methanol | 55.0 |
| Acetone | 30.0 |
| Methyl Cellosolve Acetate | 5.0 |
| Formic Acid | 10.0 |
| Tartaric Acid | 1.0 |
| 2,1-naphthalene-diazo-oxide-4-sodium sulfonate | 3.8 |

The solution is warmed to help in dissolving the diazo-oxide. It is then mixed with the lacquer solution in a 1:1.5 ratio and coated on the polyester base, with a No. 60 Meyer Bar. The sheet is then dried in an oven at 100° C. for one minute.

After drying, the sheet is exposed imagewise for 8 seconds at Low Intensity on A DSG 1400 exposure device and developed in an Arkwright 404 ammonia developer. The film is allowed to de-ammoniate for 3–5 minutes at room temperature, after which it is re-exposed overall for 60 seconds from the same side as the original exposure and developed for a second time to obtain the amplified image.

The image density before amplification is 0.55, and 0.83 after.

EXAMPLE 3

A light-sensitive formulation comprising the following components is prepared for coating on ICI 505 polyester film:

| | Grams |
|---|---|
| Methanol | 55.0 |
| Acetone | 30.0 |
| Methyl Cellosolve Acetate | 5.0 |
| Formic Acid | 10.0 |
| Citric Acid | 2.0 |
| 4-chloro-1,2-benzoquinone diazide | 1.55 |

The sensitizer solution and the lacquer solution are mixed in a 1:1 ratio and coated first, on one side of the polyester base with a No. 40 Meyer Bar, and dried for one minute at 100° C., and then coated on the other side of the film base and dried in the same manner.

After drying, the sheet is exposed imagewise for 9 seconds at Low Intensity on a DGS 1400 exposure device and developed in an Arkwright 404 ammonia developer. The film is allowed to de-ammoniate for 3–5 minutes at room temperature, after which it is re-exposed overall for 20 seconds from the same side as the original exposure and developed for a second time to obtain the amplified image.

The image density before amplification is 0.49, and after amplification is 0.61.

EXAMPLE 4

A light-sensitive formulation comprising the following components is prepared for coating on ICI 505 polyester film:

| | Grams |
|---|---|
| Methanol | 55.0 |
| Acetone | 30.0 |
| Methyl Cellosolve Acetate | 5.0 |
| Formic Acid | 10.0 |
| Citric Acid | 1.0 |
| 4,6-dichloro-1,2-benzoquinone-diazide | 1.89 |

The sensitizer solution and the lacquer solution are mixed in a 1:1 ratio and coated first, on one side of the polyester base with a No. 40 Meyer Bar, and dried for one minute at 100° C., and then coated on the other side of the film base and dried in the same manner.

After drying, the sheet is exposed imagewise for 7 seconds at Low Intensity on a DGS 1400 exposure device and developed in an Arkwright 404 ammonia developer. The film is allowed to de-ammoniate for 3–5 minutes at room temperature, after which it is re-exposed overall for 30 seconds from the same side as the original exposure and developed for a second time to obtain the amplified image.

The image density before amplification is 0.55, and after is 0.68.

EXAMPLE 5

A light-sensitive formulation comprising the following components is prepared for coating on ICI 505 polyester film:

| | Grams |
|---|---|
| Methanol | 55.0 |
| Acetone | 30.0 |
| Methyl Cellosolve Acetate | 5.0 |
| Formic Acid | 10.0 |
| Sulfosalicylic Acid | 1.0 |
| 4-chloro-5-methyl-1,2-benzo-quinone-diazide | 1.69 |

The solution is warmed to help in dissolving the diazo-oxide. It is then mixed with the lacquer solution in a 1:1 ratio and coated on the polyester base, with a No. 60 Meyer Bar. The sheet is then dried in an oven at 100° C. for one minute.

After drying, the sheet is exposed imagewise for 7.5 seconds at Low Intensity on a DGS 1400 exposure device and developed in an Arkwright 404 ammonia developer. The film is allowed to de-ammoniate for 3–5 minutes at room temperature, after which it is re-exposed overall for 45 seconds from the same side as the original exposure and developed for a second time to obtain the amplified image.

The image density before amplification is 0.64, and after amplification is 0.75.

EXAMPLE 6

A sheet of ICI 505 polyester film is coated on one side with the same mix as in Example 1. A No. 60 Meyer Bar is used, and the sheet is dried for one minute at 100° C.. The sheet is then coated on the opposite side with the same mix as in Example 4, with a No. 60 Meyer Bar, and dried as above.

The sheet is exposed imagewise for 10 seconds at Low Intensity, using the DGS 1400, with the first coating towards the light source. It is developed, and then de-ammoniated for 3–5 minutes, after which the sheet is exposed overall for 30 seconds at Low Intensity from the first coated side, and developed for a second time on each of the two sides.

The image density before amplification is 0.92, and after amplification is 1.33.

The invention being thus described, it will be obvious that the same may be varied in many ways. Such variations are not to be regarded as a departure from the spirit and scope of the invention, and all such modifications are intended to be included within the scope of the following claims.

We claim:

1. A method for the amplification of dye images formed in a negative-working diazo material having a support and a negative-working acid stabilized diazo layer thereon wherein, on continued exposure to actinic radiation, the diazo compound goes through a photolytic transition starting with an unreactable or non-coupling state, to a reactable state, and finally to an unreactable state, the steps of image formation and amplification which comprise: (1) initially image-wise exposing the negative-working diazo layer to actinic radiation sufficient to convert a portion of the diazo compound contained therein to an active coupling constituent in the light-struck areas to form a first latent image, (2) developing the exposed diazo layer by means of an alkaline agent and/or heat to effect coupling so as to form colored incipient dye images in the light-struck areas, (3) exposing the entire diazo layer from the same side as the initial image-wise exposure to actinic radiation of a greater amount than that used in the initial exposure, said amount of actinic radiation being sufficient to substantially completely photolyze the non-image areas while simultaneously creating second latent images beneath the already-developed dye image areas, and (4) developing the exposed diazo layer again by means of an alkaline agent and/or heat to effect coupling in said second latent image areas to form color therein and to amplify the initial colored incipient dye images.

2. The method of claim 1, further comprising the steps of exposing the entire diazo layer after the developing step (4) from the side opposite that of the initial image-wise exposure to actinic radiation approximately equal to that of the initial exposure to convert any unphotolyzed diazo compound remaining under the dye image areas to an active coupling state, and developing the diazo layer exposed under said dye image areas to initiate coupling so as to further intensify said dye image areas.

3. The method of claim 1, wherein the amount of the actinic radiation in step (3) is about 2 to 100 times the amount of actinic radiation used in the initial exposure in step (1).

4. The method of claim 1, wherein said negative-working diazo layer comprises a light-photolyzable diazo compound which is capable of transition to a color-former by photolysis, and an acidic stabilizer on a suitable support.

5. The method of claim 1, wherein said negative-working diazo layer comprises a light-photolyzable inactive diazo compound which is capable of transition to an active diazo form by photolysis, an acidic stabilizer and a coupler on a suitable support.

6. The method of claim 1, wherein said negative-working diazo layer comprises multiple layers coated on a suitable support, one of said layers comprising a light-photolyzable diazo compound which is capable of transition to a color-former by photolysis and an acidic stabilizer and another of said layers comprising a light-photolyzable inactive diazo compound which is capable of transition to an active diazo form by photolysis, an acidic stabilizer and a coupler.

7. The method of claim 1, wherein the concentration of diazo compound in said layer is such that the unexposed diazo compound has an Absorbance in its region of maximum spectral absorption of greater than 1.0.

8. The method of claim 1, wherein said developing is carried out by using an alkaline agent to achieve coupling.

9. The method of claim 8, wherein said alkaline agent is ammonia.

10. The method of claim 9, wherein the diazo layer is heated after the developing step (2) in order to drive off the ammonia.

11. The method of claim 10, wherein the diazo layer is cooled after said heating step and before the exposure of step (3).

12. The method of claim 8, wherein said alkaline agent is a volatilizable amine.

13. The method of claim 12, wherein the diazo layer is heated after the developing step (2) in order to drive off the volatilizable amine.

14. The method of claim 13, wherein the diazo layer is cooled after said heating step and before the exposure of step (3).

15. The method of claim 1, wherein said developing is carried out by using heat to achieve coupling.

16. A method for the amplification of dye images formed in a negative-working diazo material having a support and a negative-working acid stabilized diazo layer thereon wherein, on continued exposure to actinic radiation, the diazo compound goes through a photolytic transition starting with an unreactable or non-coupling state, to a reactable state, and finally to an unreactable state, said diazo compound being selected from the group consisting of diazo oxides, diazo sulfonates, diazosulfones and diazocyanides, the steps of image formation and amplification which comprise: (1) initially image-wise exposing the negative-working diazo layer to actinic radiation sufficient to convert a portion of the diazo compound contained therein to an active coupling constituent in the light-struck areas to form a first latent image, (2) developing the exposed diazo layer by means of an alkaline agent and/or heat to effect coupling so as to form colored incipient dye images in the light-struck areas, (3) exposing the entire diazo layer from the same side as the initial image-wise exposure to actinic radiation of a greater amount than that used in the initial exposure, said amount of actinic radiation being sufficient to substantially completely photolyze the non-image areas while simultaneously creating second latent images beneath the already-developed dye image areas, and (4) developing the exposed diazo layer again by means of an alkaline agent and/or to heat effect coupling in said second latent image areas to form color therein and to amplify the initial colored incipient dye images.

17. The method of claim 16, further comprising the steps of exposing the entire diazo layer after the developing step (4) from the side opposite that of the initial image-wise exposure to actinic radiation approximately equal to that of the initial exposure to convert any unphotolyzed diazo compound remaining under the dye image areas to an active coupling state, and developing the diazo layer exposed under said dye image areas to initiate coupling so as to further intensify said dye image areas.

* * * * *